US011280039B2

(12) United States Patent
Roetker

(10) Patent No.: US 11,280,039 B2
(45) Date of Patent: Mar. 22, 2022

(54) COLD TEMPERATURE SANITIZING RINSE IN A WASHING MACHINE APPLIANCE

(71) Applicant: Haier US Appliance Solutions, Inc., Wilmington, DE (US)

(72) Inventor: John Joseph Roetker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 189 days.

(21) Appl. No.: 16/430,558

(22) Filed: Jun. 4, 2019

(65) Prior Publication Data

US 2020/0385910 A1 Dec. 10, 2020

(51) Int. Cl.
*D06F 35/00* (2006.01)
*D06F 39/08* (2006.01)
*D06F 39/02* (2006.01)

(52) U.S. Cl.
CPC ..... *D06F 35/006* (2013.01); *D06F 39/02* (2013.01); *D06F 39/085* (2013.01)

(58) Field of Classification Search
None
See application file for complete search history.

(56) References Cited

U.S. PATENT DOCUMENTS 3,702,069 A 11/1972 Sharpe
5,645,608 A * 7/1997 Cooper ..... C11D 11/0017 510/302
6,115,862 A 9/2000 Cooper et al.
8,490,440 B2 7/2013 Aykroyd et al.
2008/0095660 A1* 4/2008 Wong ..... D06F 35/008 422/11
2008/0276655 A1 11/2008 Luckman et al.
2015/0211166 A1 7/2015 Roetker
2017/0022648 A1* 1/2017 Roetker ..... D06F 39/083
2019/0169778 A1* 6/2019 Uchiyama ..... D06F 39/02

FOREIGN PATENT DOCUMENTS

GB 1538866 A 1/1979

* cited by examiner

*Primary Examiner* — Cristi J Tate-Sims
(74) *Attorney, Agent, or Firm* — Dority & Manning, P.A.

(57) ABSTRACT

A washing machine appliance has a drum positioned within a tub. The drum defines a wash chamber for receipt of articles for washing and sanitizing. A method of operating the washing machine appliance includes, in a rinse cycle, filling the tub with a cold water rinse volume to a predetermined fill level, adding a volume of sanitizing additive to the tub, and performing an agitation cycle for a predetermined time period. The first cold water rinse volume and the sanitizing additive are mixed during the first agitation cycle to form a sanitizing liquor. The rinse cycle further includes draining the sanitizing liquor from the tub after performing the agitation cycle and performing an extraction cycle after draining the sanitizing liquor from the tub. As a result, the washing machine appliance and articles therein are sanitized.

20 Claims, 6 Drawing Sheets

COLD TEMPERATURE SANITIZING RINSE IN A WASHING MACHINE APPLIANCE

FIELD OF THE INVENTION

The present subject matter relates generally to washing machine appliances and methods for washing articles therein, and particularly to the sanitization of articles during washing thereof.

BACKGROUND OF THE INVENTION

Washing machine appliances generally include a cabinet which supports a tub for containing wash fluid, e.g., water and detergent, bleach and/or other wash additives. A basket is mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

Many washing machine appliances utilize sanitization cycles for generally sanitizing articles being washed therein. Historically, sanitization cycles utilized thermal sanitization, heating water in the tub to relatively high temperatures for prolonged time periods to sanitize articles within the tub. However, such approaches are both energy and time intensive.

More recently, various additives in combination with specifically tailored sanitization cycles have been utilized to sanitize articles. For example, the use of additives with multiple hot water fills and multiple prolonged agitation periods for sanitization purposes. However, the requirements of multiple hot water fills and multiple prolonged agitation periods still require undesirably high energy usage.

An additional issue with presently known sanitization cycles is that the high temperature water utilized in such cycles can have an undesirable effect on some stains, such as blood. Rather than assisting in removing such stains from articles in the tub, the high temperature water can lock-in the stain.

Accordingly, improved washing machine appliances and methods for washing articles which provide improved sanitization cycles would be advantageous. In particular, improved sanitization at reduced energy levels would be desired.

BRIEF DESCRIPTION OF THE INVENTION

Aspects and advantages of the invention will be set forth in part in the following description, or may be apparent from the description, or may be learned through practice of the invention.

In accordance with one embodiment of the present disclosure, a method of operating a washing machine appliance is provided. The washing machine appliance has a drum positioned within a tub. The drum defines a wash chamber for receipt of articles for washing and sanitizing. The method includes performing a rinse cycle. The rinse cycle includes filling the tub with a first cold water rinse volume to a first predetermined fill level, adding a volume of sanitizing additive to the tub, and performing a first agitation cycle for a first predetermined time period after filling the tub with the first cold water rinse volume and adding the volume of sanitizing additive to the tub. The first cold water rinse volume and the sanitizing additive are mixed during the first agitation cycle to form a sanitizing liquor. The rinse cycle further includes draining the sanitizing liquor from the tub after performing the first agitation cycle and performing a first extraction cycle after draining the sanitizing liquor from the tub. The rinse cycle also includes filling the tub with a second cold water rinse volume to a second predetermined fill level and performing a second agitation cycle for a second predetermined time period after filling the tub with the second cold water rinse volume. The rinse cycle further includes draining the second cold water rinse volume from the tub after performing the second agitation cycle and performing a second extraction cycle after draining the second cold water rinse volume from the tub. As a result, the washing machine appliance and articles therein are sanitized.

In accordance with another embodiment of the present disclosure, a method of operating a washing machine appliance is provided. The washing machine appliance has a drum positioned within a tub. The drum defines a wash chamber for receipt of articles for washing and sanitizing. The method includes performing a rinse cycle. The rinse cycle includes filling the tub with a cold water rinse volume to a predetermined fill level, adding a volume of sanitizing additive to the tub, and performing an agitation cycle for a predetermined time period after filling the tub with the cold water rinse volume and adding the volume of sanitizing additive to the tub. The first cold water rinse volume and the sanitizing additive are mixed during the first agitation cycle to form a sanitizing liquor. The rinse cycle further includes draining the sanitizing liquor from the tub after performing the agitation cycle and performing an extraction cycle after draining the sanitizing liquor from the tub. As a result, the washing machine appliance and articles therein are sanitized.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
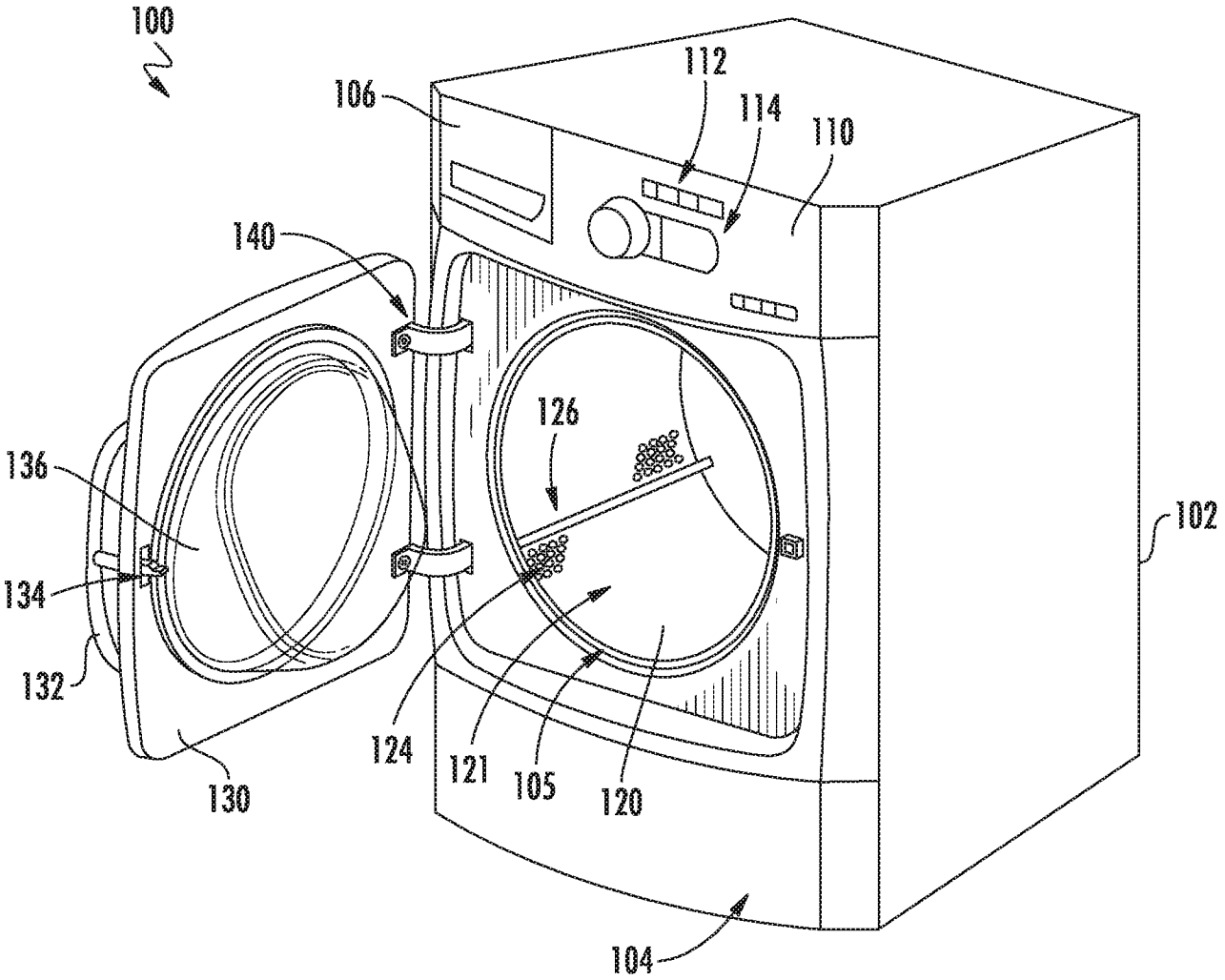
FIG. 1 provides a perspective view of an example washing machine appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

FIG. 1 illustrates an exemplary horizontal axis front load washing machine appliance 100. A drum 120 of washing machine appliance 100 rotates about a substantially horizontal axis. Thus, washing machine appliance 100 is generally referred to as a horizontal axis washing machine appliance 100. However, while described in the context of washing machine appliance 100, using the teachings disclosed herein, it will be understood that washing machine appliance 100 is provided by way of example only. Other washing machine appliances having different configurations, different appearances, and/or different features may also be utilized with the present subject matter as well, such as vertical axis washing machine appliances.

Figure 2:
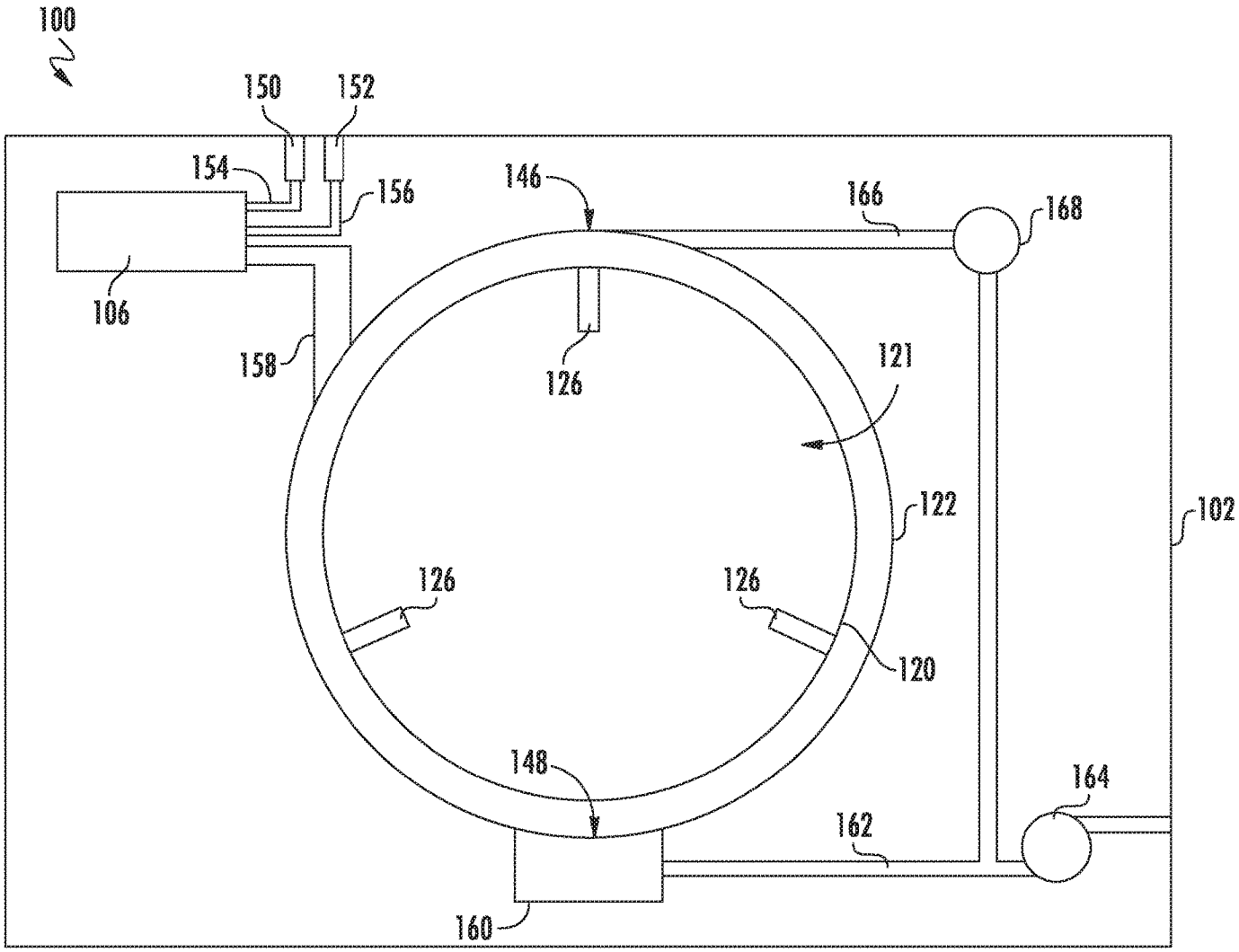
FIG. 2 provides a schematic view of the example washing machine appliance of FIG. 1.

Washing machine appliance 100 has a cabinet 102 with a tub 122 mounted therein. Tub 122 is configured for containing wash fluid during operation of washing machine appliance 100. Drum 120 is rotatably mounted within tub 122. Drum 120 extends between a top portion 146 (FIG. 2) and a bottom portion 148 (FIG. 2). Top and bottom portions 146 and 148 of drum 120 are, e.g., vertically, spaced apart from each other. A motor may be in mechanical communication with drum 120 in order to selectively rotate drum 120 (e.g., during an agitation, a spin, or a tumble cycle of washing machine appliance 100). Drum 120 defines a wash chamber 121 that is configured for receipt of articles for washing. Ribs 126 may extend from drum 120 into wash chamber 121. Ribs 126 assist with agitating articles disposed within wash chamber 121 during operation of washing machine appliance 100. For example, ribs 126 may lift articles disposed in drum 120 to top portion 146 of drum 120 during rotation of drum 120 and such articles may subsequently fall to bottom portion 148 of drum 120. Drum 120 also defines a plurality of holes 124. Holes 124 are configured to permit a flow of wash fluid and/or air between wash chamber 121 of drum 120 and tub 122. A detergent drawer 106 is slidably mounted within cabinet 102. Detergent drawer 106 receives detergent and directs the detergent to wash chamber 121 or tub 122 during operation of appliance 100. Detergent drawer 106 may further receive various additives as discussed herein and direct the additives to wash chamber 121 or tub 122 during operation of appliance 100.

Cabinet 102 of washing machine appliance defines an opening 105 that permits user access to wash chamber 121 of drum 120. A door 130 is mounted to cabinet 102 at opening 105 with a hinge 140. A window 136 in door 130 permits viewing of wash chamber 121 during operation of appliance 100. Door 130 also includes a handle 132 that, e.g., a user may pull when opening and closing door 130. Latch 134 is configured for selectively securing door 130 in a closed position.

A control panel 110 with a plurality of input selectors 112 is also mounted to cabinet 102. Control panel 110 and input selectors 112 collectively form a user interface for operator selection of machine cycles and features. A display 114 of control panel 130 indicates selected features, a countdown timer, and/or other items of interest to appliance users.

FIG. 2 provides a schematic view of one embodiment of washing machine appliance 100. As may be seen in FIG. 2, washing machine appliance 100 includes a cold water inlet 150 and a hot water inlet 152. Cold water inlet 150 is in fluid communication with a water source, such as a municipal water main or a well. Thus, cold water inlet 150 is configured for receipt of relatively cold water from the water source. A cold water conduit 154 extends between and fluidly connects cold water inlet 150 and detergent drawer 106. Thus, relatively cold water from cold water inlet 150 can flow through cold water conduit 154 to detergent drawer 106. Conversely, hot water inlet 152 is in fluid communication with a hot water source, such as a hot water heater. Thus, hot water inlet 152 is configured for receipt of relatively hot water from the hot water source. A hot water conduit 156 extends between and fluidly connects hot water inlet 152 and detergent drawer 106. Thus, relatively hot water from hot water inlet 152 can flow through hot water conduit 156 to detergent drawer 106. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

An inlet conduit 158 extends between and fluidly connects detergent drawer 106 and drum 120 or tub 122. Thus, fluid within detergent drawer 106 can flow through inlet conduit 158 into wash chamber 121 of drum 120 or tub 122. As an example, a user can add detergent and an additive, such as bleach, fabric softener, other additives as discussed herein, etc., to detergent drawer 106. Water from cold water inlet 150 and/or hot water inlet 152 can flow into detergent drawer 106 and mix with fluid additive to form a wash fluid. Such wash fluid can flow through inlet conduit 158 into wash chamber 121 of drum 120 or tub 122 in order to assist with cleaning articles disposed within wash chamber 121.

Washing machine appliance 100 also includes a sump 160, e.g., positioned at bottom portion 148 of drum 120 or a bottom portion (not shown) of tub 122 positioned at or proximate bottom portion 148 of drum 120. Liquids within wash chamber 121 can collect within sump 160 during operation of washing machine appliance 100, e.g., due to gravity. A drain conduit 162 is configured for directing liquids out of sump 160. In particular, a drain pump 164 is configured for urging liquids out of sump 160 through drain conduit 162. Liquids within drain conduit 162 may be directed out of washing machine appliance 100, e.g., to a sewer or septic system or may be diverted from the drain by a recirculation pump 168, as described in more detail below. In particular, drain pump 164 can urge liquids within sump 160 out of washing machine appliance 100 through drain conduit 162. As an example, drain pump 164 can be activated during a drain cycle of washing machine appliance 100 in order to remove dirty or used wash fluid from sump 160.

A recirculation conduit 166, e.g., positioned at top portion 146 of drum 120 or a top portion (not shown) of tub 122 positioned at or proximate top portion 146 of drum 120, is configured for circulating fluids, e.g., wash liquor and/or sanitizing liquor, through washing machine appliance 100, e.g., through wash chamber 121 of drum 120 and/or tub 122. For example, the recirculation pump 168 may be configured for urging fluids out of wash chamber 121 of drum 120 and/or tub 122 through drain conduit 162 and back to the wash chamber 121 via recirculation conduit 166. The several components described herein may comprise a fluid circulation system of the washing machine appliance 100, e.g., the fluid circulation system of the washing machine appliance 100 may include the drain conduit 162, the recirculation pump 168, the recirculation conduit 166, the wash chamber 121, and the sump 160.

As an example, a user can load articles for washing into wash chamber 121, and the user can initiate washing operation through manipulation of input selectors 112 of control panel 110. Washing machine appliance 100, e.g., a controller thereof, then actuates cold water inlet 150 and/or hot water inlet 152 in order to fill drum 120 and/or tub 122 with water and/or detergent and additives to form a wash fluid in the manner discussed above. Once drum 120 and/or tub 122 is properly filled with wash fluid, the controller activates motor 142 in order to, for example, agitate the articles within wash chamber 121 with ribs 126 and assist with cleansing such articles.

After one or more agitation cycles of a wash cycle are completed, washing machine appliance 100 activates drain pump 164 to remove wash fluid from drum 120 and/or tub 122. Articles can then be rinsed by adding relatively clean fluid to drum 120 and/or tub 122 and, depending on the particulars of the cleaning cycle selected by a user, ribs 126 may again provide agitation within wash chamber 121. One or more spin cycles may also be used. In particular, a spin cycle may be applied after the wash cycle and/or after the rinse cycle in order to wring wash fluid from the articles being washed. During a spin cycle, drum 120 is rotated at relatively high speeds.

As mentioned, water can be flowed into drum 120 and/or tub 122 from cold water inlet 150 and/or hot water inlet 152. A volume of water, i.e., an amount of water that is provided into drum 120 and/or tub 122 during a single fill, can be a hot water volume and thus be at a hot temperature when flowed into the drum 120 and/or tub 122, or can be a warm water volume and thus be at a warm temperature when flowed into the drum 120 and/or tub 122, or can be a cold water volume and thus be at a cold temperature when flowed into the drum 120 and/or tub 122. A hot temperature, and thus the temperature of a hot water volume, may for example be between approximately 110 and approximately 130 degrees Fahrenheit, such as between approximately 115 and approximately 125 degrees Fahrenheit. A warm temperature, and thus the temperature of a warm water volume, may for example be between approximately 70 and approximately 105 degrees Fahrenheit, such as between approximately 75 and approximately 95 degrees Fahrenheit. A cold temperature, and thus the temperature of a cold water volume, may for example be between approximately 32 and approximately 80 degrees Fahrenheit, such as between approximately 35 and approximately 70 degrees Fahrenheit, such as between about 35 degrees Fahrenheit and about 60 degrees Fahrenheit. A cold water volume may be obtained through operation of the cold water inlet 150 to flow water therethrough while not operating the hot water inlet 152. A hot water volume may be obtained through operation of the hot water inlet 152 to flow water therethrough while not operating the cold water inlet 150. A warm water volume may be obtained through operation of the cold water inlet 150 and the hot water inlet 152 to flow water therethrough. Additionally, the temperatures of the water when flowed into the drum 120 and/or tub 122 are and remain the same or about the same as the temperatures used throughout the applicable cycle.

Figure 3:
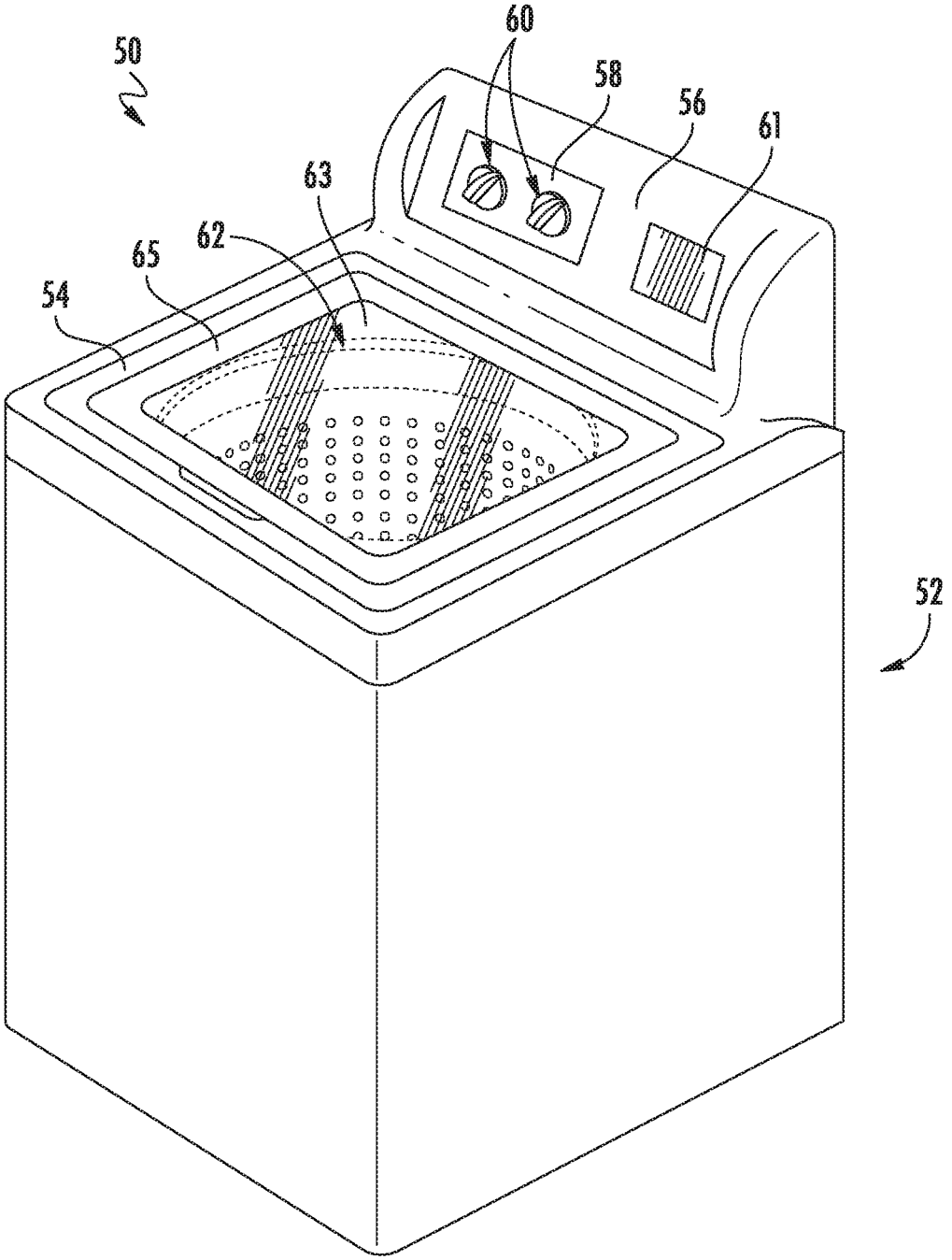
FIG. 3 provides a perspective view of a washing machine appliance according to one or more additional exemplary embodiments of the present disclosure.

FIG. 3 is a perspective view of a vertical axis top load washing machine appliance 50 according to an additional exemplary embodiment of the present subject matter. As may be seen in FIG. 3, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 4) located within cabinet 52 and a closed position (shown in FIG. 3) forming an enclosure over tub 64.

Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 4:
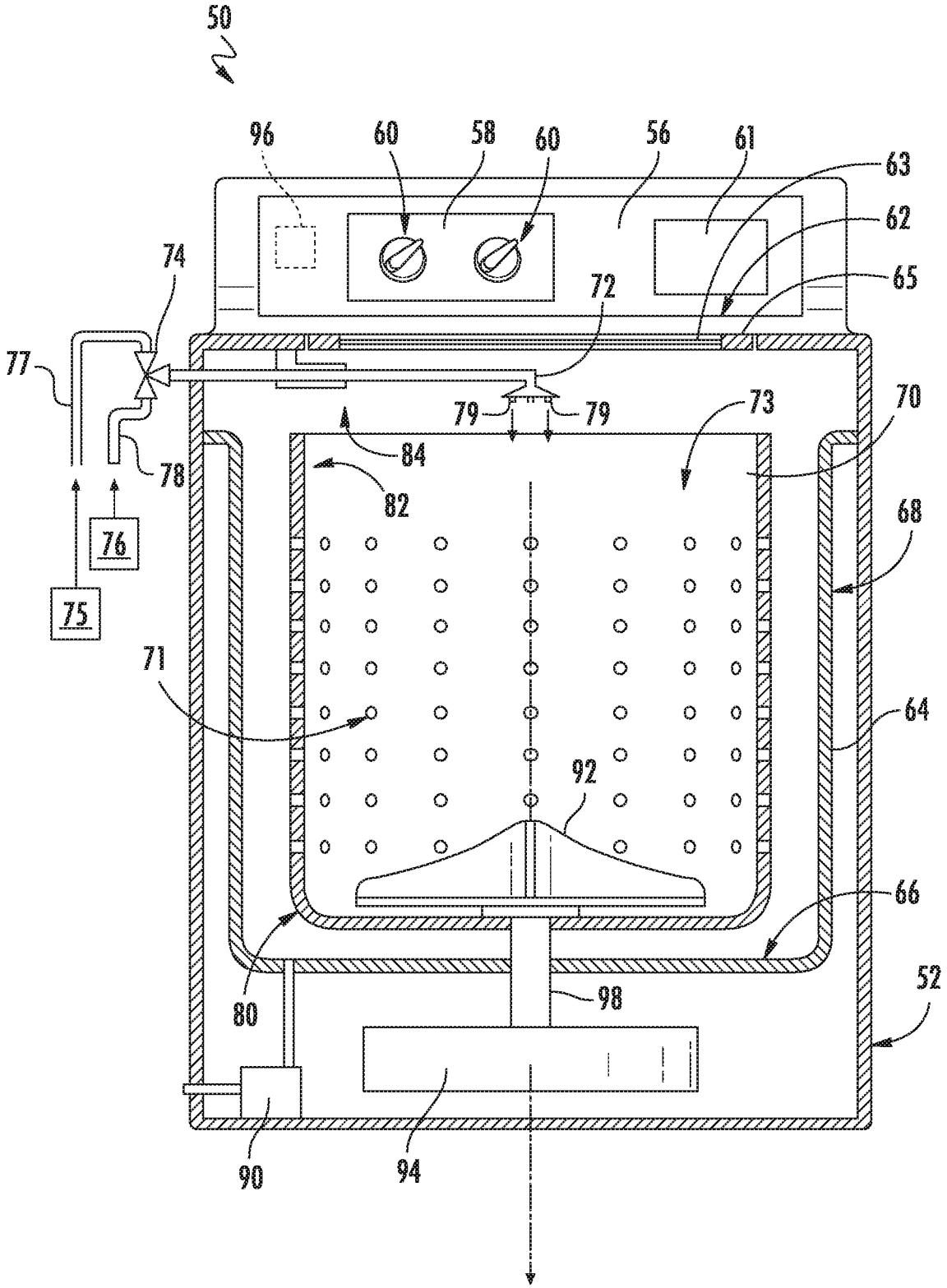
FIG. 4 provides a front, section view of the exemplary washing machine appliance of FIG. 3.

FIG. 4 provides a front, cross-section view of the exemplary washing machine appliance 50 of FIG. 3. As may be seen in FIG. 4, tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 76, 77 in order to direct liquid (e.g. water) into tub 64 and/or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

Various valves may regulate the flow of fluid through nozzle 72. For example, a flow regulator may be provided to control a flow of hot and/or cold water into the wash chamber of washing machine appliance 50. For the embodiment depicted, the flow regulator includes a hot water valve 74 and a cold water valve 75. The hot and cold water valves 74, 75 are utilized to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. More particularly, as will be discussed below, additive dispenser 84 may be provided to direct a sanitizing additive into the tub 64. For example, dispenser 84 may be in fluid communication with nozzle 72 such that water flowing through nozzle 72 flows through dispenser 84, mixing with wash additive at a desired time during operation to form a wash liquor or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 4) is located beneath tub 64 and basket 70 for gravity assisted flow to drain tub 64.

An agitation element 92, shown as an impeller in FIG. 4, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 4, agitation element 92 is oriented to rotate about vertical axis V. Alternatively, basket 70 may provide such agitating movement, and agitation element 92 is not required. Basket 70 and agitation element 92 are driven by a motor 94, such as a pancake motor. As motor output shaft 98 is rotated, basket 70 and agitation element 92 are operated for rotatable movement within tub 64, e.g., about vertical axis V. It should be appreciated, however, that in other exemplary embodiments, the exemplary washing machine appliance 50 may not include an agitation element 92, and instead wash machine appliance 50 may agitate articles positioned within wash chamber 73 by, e.g., rotating basket 70. Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 96, that is operatively coupled to the input selectors 60 located on washing machine backsplash 56 for user manipulation to select washing machine cycles and features. Controller 96 may further be operatively coupled to various other components of appliance 50, such as the valves 74, 75, motor 94, and various sensors, etc. In response to user manipulation of the input selectors 60, controller 96 may operate the various components of washing machine appliance 50 to execute selected machine cycles and features.

Controller 96 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 96 via one or more signal lines or shared communication busses. It should be noted that controllers 96 as disclosed herein are capable of and may be operable to perform any methods and associated method steps as disclosed herein.

While described in the context of specific embodiments of washing machine appliance 50 and 100, using the teachings disclosed herein it will be understood that washing machine appliances 50 and 100 are provided by way of example only. Other washing machine appliances having different configurations, different appearances, and/or different features may also be utilized with the present subject matter as well.

Figure 5:
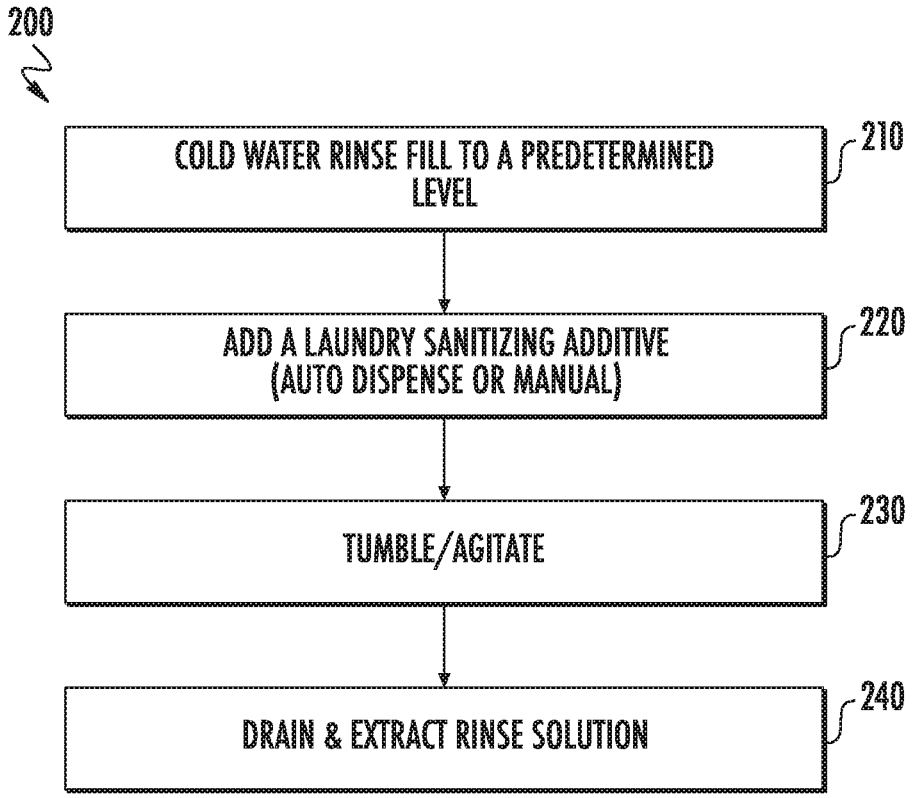
FIG. 5 provides a flowchart illustrating an exemplary method of operating a washing machine appliance in accordance with one or more exemplary embodiments of the present disclosure.
Figure 6:
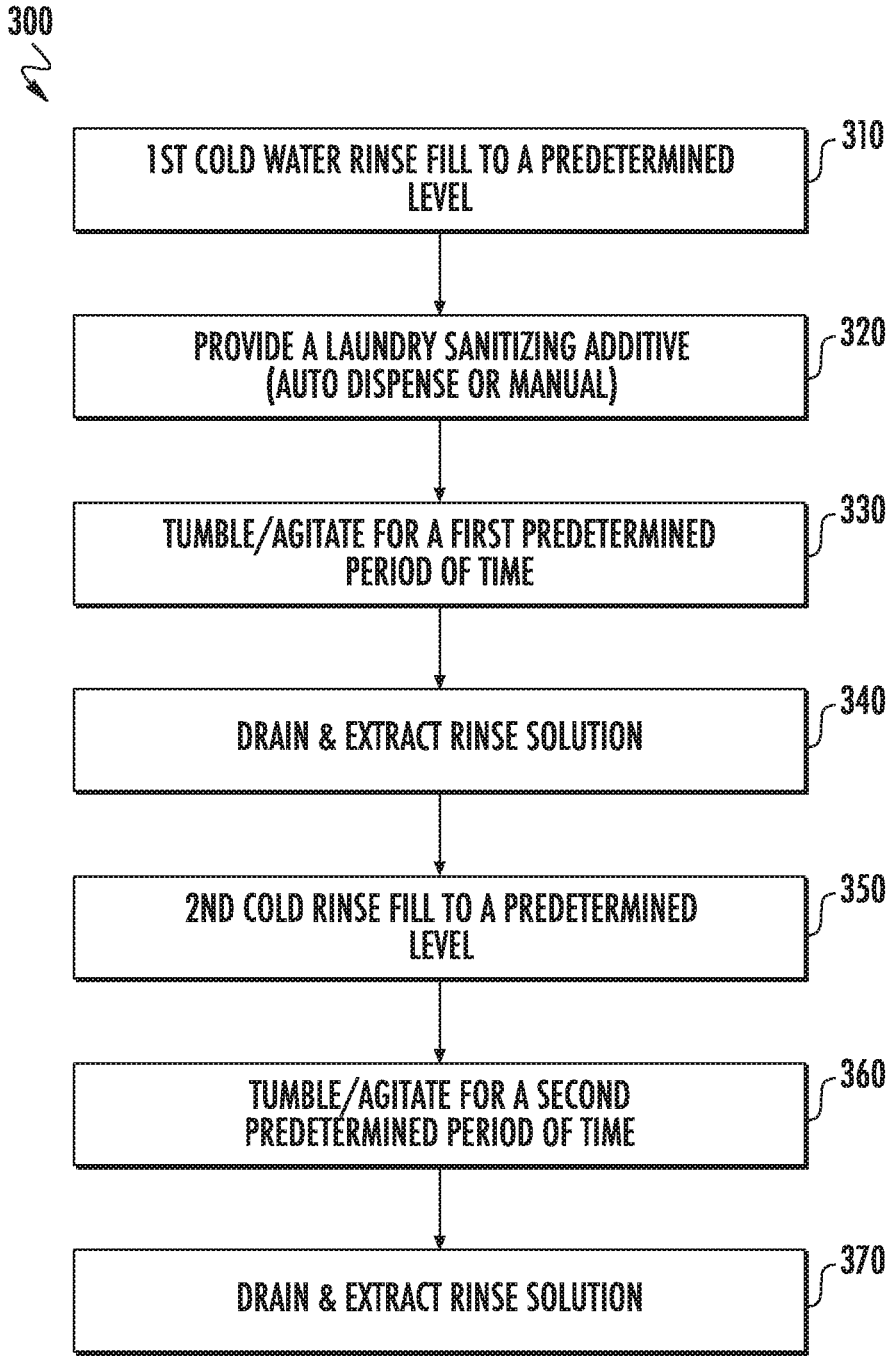
FIG. 6 provides a flowchart illustrating an exemplary method of operating a washing machine appliance in accordance with one or more additional exemplary embodiments of the present disclosure.

FIGS. 5 and 6 illustrate exemplary methods 200 and 300 for operating a washing machine appliance according to exemplary embodiments of the present subject matter. Such methods can advantageously provide improved washing machine appliance operation when sanitization of articles is required, by for example, advantageously requiring only the use of cold water for sanitization, which reduces or eliminates the risk of color of fabric damage typically associated with thermal sanitization and/or harsh additives such as bleach. In exemplary embodiments, a controller of the washing machine appliance (e.g., controller 96 as illustrated in FIG. 4) can generally be programmed to implement such methods, and thus may be configured to perform the various steps thereof. As described in more detail below, methods 200 and 300 may include performing a rinse cycle. In some embodiments, the rinse cycle may be a portion of an overall cycle or operation of the washing machine appliance. For example, the method 200 or 300 may also include performing a wash cycle prior to the rinse cycle. In some embodiments, upon completion of the method 200 or 300, the overall wash cycle may end. After the method 200 or 300 is complete, the washing machine appliance and articles therein may be sanitized as a result of the method 200 or 300.

Turning specifically to FIG. 5, the method 200 may, in some embodiments, include, for example, the step 210 of filling the tub with a cold water rinse volume to a predetermined fill level. The predetermined fill level is a total liquid level within the tub. The predetermined fill level may for example be dependent upon the article volume size, and thus for example may be based on the weight of the articles in the tub. For example, the predetermined fill level may be between approximately 0.5 and approximately 3.0 gallons per pound of articles within the tub, such as between approximately 1.0 and approximately 2.5 gallons per pound of articles within the tub, such as between approximately 1.5 and approximately 2.0 gallons per pound of articles within the tub. In at least some embodiments, the method 200 may be a single-rinse sanitization method. For example, the method 200 may be a single-rinse method in that the rinse volume of step 210 may be the only volume of water flowed into the tub or otherwise used in the tub during the entire rinse cycle. As another example, the rinse volume of step 210 may be one of two rinse volumes with which the tub is filled during the entire rinse cycle. Such embodiments of method 200, where the cold water rinse volume is the only rinse volume or one of two rinse volumes, may be particularly suited for a top load (vertical axis) washing machine appliance, such as the example washing machine appliance 50 illustrated in FIGS. 3 and 4. In various embodiments the rinse volume, or all of the rinse volumes where more than one is provided, is/are only at a cold temperature throughout the duration of the rinse cycle.

Method 200 may further include a step 220 of adding a volume of sanitizing additive to the tub. The volume of sanitizing additive may be between about one milliliter and about six milliliters per liter (1-6 mL/L) of the cold water rinse volume, such as between about two milliliters and about four milliliters per liter (2-4 mL/L) of the cold water rinse volume, such as about three milliliters per liter (3 mL/L) of the cold water rinse volume. The sanitizing additive may be provided at step 220 in any suitable manner. For example, in some exemplary embodiments, the sanitizing additive may be provided through a dispenser assembly, such as dispenser 84 or detergent drawer 106 described above, or alternatively may be provided directly to the wash chamber by, e.g., a user.

After filling the tub with the cold water rinse volume and adding the volume of sanitizing additive to the tub, the method 200 may include a step 230 of performing an agitation cycle for a predetermined time period. The cold water rinse volume and the sanitizing additive may be mixed during the agitation cycle to form a sanitizing liquor. The method 200 may provide cold sanitizing. The sanitizing liquor may be at or about the same temperature as the cold water rinse, e.g., the sanitizing liquor may not be heated and the sanitizing process may otherwise not include adding thermal energy to the wash chamber and/or articles therein.

The agitation cycle generally agitates the articles and wash fluid, including the cold water rinse volume and sanitizing additive, within the tub. In exemplary embodiments, such step 230 may include rotating a drum of the washing machine appliance in the agitation cycle. The step 230 may, additionally or alternatively, include reversible rotation of an agitation element relative to drum. Such rotation of the drum and/or agitation element may include various steps of rotating and/or holding stationary to allow articles within the wash chamber to soak within the sanitizing liquor. For example, the agitation cycle may include rotating for a rotation period of between approximately 0.5 seconds and approximately 2.0 seconds, such as between approximately 1.0 seconds and approximately 1.5 seconds, and may further include holding stationary for a soak period. In various embodiments, the soak period may be at least about two seconds and may be as much as about five minutes. For example, the soak period may be between approximately 5 seconds and approximately 3 minutes. The rotations of the drum and/or agitation element may be performed at any suitable speeds. For example, the reversible rotation of the agitation element may be performed between approximately 75 revolutions per minute ("RPM") and approximately 200 RPM, such as between approximately 90 RPM and approximately 140 RPM, such as between approximately 110 RPM and approximately 130 RPM. As another example, rotation of the drum may be performed between approximately 3 RPM and approximately 75 RPM, such as between approximately 5 RPM and approximately 60 RPM, such as between approximately 10 RPM and approximately 45 RPM. Such rotation and holding may be repeated as required, and repeated rotations may occur in opposite directions, such as clockwise, then counterclockwise, then clockwise, etc. Further, additional or alternative patterns of rotation (at any suitable speeds) and/or holding may be utilized in an agitation cycle as desired or required.

In some embodiments, e.g., when a recirculation pump is provided, the wash fluid and/or sanitizing liquor may be recirculated within the washing machine appliance, e.g., by activating the recirculation pump. Such recirculation may advantageously provide fabric wetting and additive mixing, as well as sanitization of the fluid circulation system of the washing machine appliance. For example, recirculation may be provided during the agitation cycle, or at least a portion of the agitation cycle. The portion of the agitation cycle may be about 75% of the agitation cycle or more, such as about 80% of the agitation cycle or more, such as about 90% of the agitation cycle or more, such as about 95% of the agitation cycle. The portion of the agitation cycle may be an initial portion of the agitation cycle, for example, recirculation may be provided during the first 90% of the agitation cycle.

As discussed, the agitation cycle may be performed for a predetermined time period. In various exemplary embodiments, the predetermined time period may be between approximately 10 minutes and approximately 30 minutes, such as between approximately 15 and approximately 25 minutes, such as about 16 minutes or about 20 minutes. In some embodiments, the predetermined time period for performing the agitation cycle may be at least about fifteen (15) minutes.

Method 200 may further include the step 240 of draining the sanitizing liquor from the tub after performing the agitation cycle and performing an extraction cycle after draining the sanitizing liquor from the tub. Drain conduit 162 and drain pump 164 may, for example, be utilized to drain such water, etc. as discussed above. The extraction cycle may extract wash fluid, e.g., water and/or additives such as detergent, sanitizing additive, etc., from the articles within the wash chamber. Rotation of the drum in the extraction cycle may occur for example at a speed between approximately 300 RPM and approximately 1500 RPM, such as between approximately 800 RPM and approximately 1200 RPM. The extraction cycle may be performed for a predetermined period of time, such as between about eight minutes and about sixteen minutes.

In some embodiments, the cold water rinse volume of step 210 may be a first cold water rinse volume, and method 200 may also include filling the tub with a second cold water rinse volume to a second predetermined fill level. In such embodiments, the method 200 may further include adding a volume of a second additive. For example, the second additive may be a fabric softener. In embodiments which include the second cold water rinse and the second additive, filling the tub with the second cold water rinse volume and adding the volume of the second additive may be performed after performing the extraction cycle.

The agent concentration, e.g., the ratio of the volume of sanitizing additive to the cold water rinse volume in step 220 above, and the exposure time, e.g., the total duration of the agitation cycle in step 230 described above, may vary to achieve sanitization efficacy based on the chemical composition of the sanitizing additive.

Turning now to FIG. 6, the method 300 may, in some exemplary embodiments, include a step 310 of filling the tub with a first cold water rinse volume to a first predetermined fill level. The first predetermined fill level is a total liquid level within the tub. The first predetermined fill level may for example be dependent upon the article volume size, and thus for example may be based on the weight of the articles in the tub. For example, the first predetermined fill level may be between approximately 0.5 and approximately 3.0 gallons per pound of articles within the tub, such as between approximately 1.0 and approximately 2.5 gallons per pound of articles within the tub, such as between approximately 1.5 and approximately 2.0 gallons per pound of articles within the tub.

In at least some embodiments, the method 300 may be a multi-rinse sanitization method. For example, the method 300 may be a multi-rinse method in that the method 300 may further include a second cold water rinse volume, as described in more detail below. Multi-rinse sanitation methods such as method 300 may be particularly suited for a front load (horizontal axis) washing machine appliance, such as the example washing machine appliance 100 illustrated in FIGS. 1 and 2. In various embodiments, all of the rinse volumes are only at a cold temperature throughout the duration of the rinse cycle, e.g., the rinse volumes comprise cold water flowed into the tub and the tub is filled with cold water, e.g., the cold water is not heated after filling the tub.

Method 300 may further include a step 320 of adding a volume of sanitizing additive to the tub. The volume of sanitizing additive may be between about one milliliter and about six milliliters per liter (1-6 mL/L) of the cold water rinse volume, such as between about two milliliters and about four milliliters per liter (2-4 mL/L) of the cold water rinse volume, such as about three milliliters per liter (3 mL/L) of the cold water rinse volume. The sanitizing additive may be provided at step 320 in any suitable manner. For example, in some exemplary embodiments, the sanitizing additive may be provided through a dispenser assembly, such as dispenser 84 or detergent drawer 106 described above, or alternatively may be provided directly to the wash chamber by, e.g., a user.

After filling the tub with the first cold water rinse volume and adding the volume of sanitizing additive to the tub, the method 300 may include a step 330 of performing a first agitation cycle for a first predetermined time period. The first cold water rinse volume and the sanitizing additive may be mixed during the first agitation cycle to form a sanitizing liquor. The method 300 may provide cold sanitizing. The sanitizing liquor may be at or about the same temperature as the first cold water rinse, e.g., the sanitizing liquor may not be heated and the sanitizing process may otherwise not include adding thermal energy to the wash chamber and/or articles therein.

The first agitation cycle generally agitates the articles and wash fluid, including the first cold water rinse volume and sanitizing additive, within the tub. In exemplary embodiments, such step 330 may include rotating a drum of the washing machine appliance in the first agitation cycle. The step 230 may, additionally or alternatively, include rotating an agitation element relative to drum. Such rotation of the drum and/or agitation element may include various steps of rotating and/or holding stationary to allow articles within the wash chamber to soak within the sanitizing liquor. For example, the first agitation cycle may include rotating for a rotation period of between approximately 5 seconds and approximately 20 seconds, such as between approximately 10 seconds and approximately 15 seconds, and may further include holding stationary for a soak period of between approximately 2 seconds and approximately 10 seconds, such as between approximately 2 seconds and approximately 6 seconds. The rotations of the drum and/or agitation element may be performed at any suitable speeds, such as for example between approximately 30 revolutions per minute ("RPM") and approximately 60 RPM, such as between approximately 40 RPM and approximately 50 RPM. Such rotation and holding may be repeated as required, and repeated rotations may occur in opposite directions, such as clockwise, then counterclockwise, then clockwise, etc. Further, additional or alternative patterns of rotation (at any suitable speeds) and/or holding may be utilized in an agitation cycle as desired or required.

In some embodiments, e.g., when a recirculation pump is provided, the wash fluid and/or sanitizing liquor may be recirculated within the washing machine appliance, e.g., by activating the recirculation pump. Such recirculation may advantageously provide fabric wetting and additive mixing, as well as sanitization of the fluid circulation system of the washing machine appliance. For example, recirculation may be provided during the first agitation cycle, or at least a portion of the first agitation cycle. The portion of the first agitation cycle may be about 75% of the first agitation cycle or more, such as about 80% of the first agitation cycle or more, such as about 90% of the first agitation cycle or more, such as about 95% of the first agitation cycle. The portion of the first agitation cycle may be an initial portion of the first agitation cycle, for example, recirculation may be provided during the first 90% of the first agitation cycle.

As discussed, the first agitation cycle may be performed for a first predetermined time period. In various exemplary embodiments, the first predetermined time period may be between approximately 10 minutes and approximately 30 minutes, such as between approximately 15 and approximately 25 minutes, such as about 16 minutes or about 20 minutes. In some embodiments, the first predetermined time period for performing the first agitation cycle may be at least about fifteen (15) minutes.

Method 300 may further include the step 340 of draining the sanitizing liquor from the tub after performing the first agitation cycle and performing a first extraction cycle after draining the sanitizing liquor from the tub. Drain conduit 162 and drain pump 164 may, for example, be utilized to drain such water, etc. as discussed above. The first extraction cycle may extract wash fluid, e.g., water and/or additives such as detergent, sanitizing additive, etc., from the articles within the wash chamber. Rotation of the drum in the first extraction cycle may occur for example at a speed between approximately 300 RPM and approximately 1500 RPM, such as between approximately 800 RPM and approximately 1200 RPM. The first extraction cycle may be performed for a predetermined period of time, such as between about eight minutes and about sixteen minutes.

Method 300 may further include a step 350 of filling the tub with a second cold water rinse volume to a second predetermined fill level. The second predetermined fill level may be about the same as the first predetermined fill level. For example, the second predetermined fill level may be between about one gallon of cold water per pound of fabric and about two and a half gallons of cold water per pound of fabric.

After filling the tub with the second cold water rinse volume, method 300 may further include a step 360 of performing a second agitation cycle for a second predetermined time period. In some embodiments, method 300 may also include adding a volume of a second additive, such as a fabric softener, after filling the tub with the second cold water rinse volume, e.g., after performing the first extraction cycle, and before the second agitation cycle. The second predetermined time period for the second agitation cycle may be less than the first predetermined time period. For example, the second predetermined time period may be between about one minute and about five minutes, such as about three minutes.

Method 300 may also include a step 370 of draining the second cold water rinse volume from the tub after performing the second agitation cycle and performing a second extraction cycle after draining the second cold water rinse volume from the tub. Draining the second cold water rinse volume may be performed in substantially the same manner as draining the first cold water rinse volume, as described above. The second extraction cycle may be performed in substantially the same manner as the first extraction cycle, as described above.

In some embodiments, the method 300 may also include a pre-rinse prior to filling the tub with the first cold water rinse volume. For example, the pre-rinse may include, prior to filling the tub with the first cold water rinse volume, filling the tub with a pre-rinse cold water volume, performing a pre-rinse agitation cycle, and draining the pre-rinse cold water volume from the tub after the pre-rinse agitation cycle. For example, the pre-rinse agitation cycle prior to the filling the tub with the first cold water rinse volume may be performed for a predetermined period of time, such as between about five minutes and about ten minutes, such as between about seven minutes and about nine minutes.

The agent concentration, e.g., the ratio of the volume of sanitizing additive to the cold water rinse volume in step 320 above, and the exposure time, e.g., the total duration of the agitation cycle in step 330 described above, may vary to achieve sanitization efficacy based on the chemical composition of the sanitizing additive.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance having a drum positioned within a tub, the drum defining a wash chamber for receipt of articles for washing and sanitizing, the method comprising:

performing a rinse cycle, the rinse cycle comprising:

filling the tub with a first cold water rinse volume to a first predetermined fill level, the first cold water rinse volume having a temperature between 35 degrees Fahrenheit and 60 degrees Fahrenheit;

adding a volume of sanitizing additive to the tub;

performing a first agitation cycle for a first predetermined time period after filling the tub with the first cold water rinse volume and adding the volume of sanitizing additive to the tub, wherein the first cold water rinse volume and the sanitizing additive are mixed during the first agitation cycle to form a sanitizing liquor at within ten percent greater or less than the temperature of the first cold water rinse volume;

draining the sanitizing liquor from the tub after performing the first agitation cycle;

performing a first extraction cycle after draining the sanitizing liquor from the tub;

filling the tub with a second cold water rinse volume to a second predetermined fill level;

performing a second agitation cycle for a second predetermined time period after filling the tub with the second cold water rinse volume;

draining the second cold water rinse volume from the tub after performing the second agitation cycle; and performing a second extraction cycle after draining the second cold water rinse volume from the tub;

whereby the washing machine appliance and articles therein are sanitized.

2. The method of claim 1, further comprising activating a recirculation pump during at least a portion of the first agitation cycle whereby the recirculation pump circulates the sanitizing liquor within a fluid distribution system of the washing machine appliance during at least a portion of the first agitation cycle.

3. The method of claim 1, wherein the first predetermined fill level and the second predetermined fill level are each between about one gallon and two and a half gallons per pound of articles in the wash chamber.

4. The method of claim 1, wherein the volume of sanitizing additive is between about two milliliters and about four milliliters per liter of the first cold water rinse volume.

5. The method of claim 1, wherein the first predetermined time period for performing the first agitation cycle is at least about fifteen minutes.

6. The method of claim 1, wherein the second predetermined time period is less than the first predetermined time period.

7. The method of claim 1, further comprising performing a wash cycle prior to the rinse cycle.

8. The method of claim 1, wherein the first cold water rinse volume and the second cold water rinse volume are each at a temperature of between about 35 degrees Fahrenheit and about 60 degrees Fahrenheit.

9. The method of claim 1, further comprising adding a volume of a second additive after performing the first extraction cycle and before performing the second agitation cycle.

10. The method of claim 1, further comprising, prior to filling the tub with the first cold water rinse volume, filling the tub with a pre-rinse cold water volume, performing a pre-rinse agitation cycle, and draining the pre-rinse cold water volume from the tub after the pre-rinse agitation cycle.

11. A method of operating a washing machine appliance, the washing machine appliance having a drum positioned within a tub, the drum defining a wash chamber for receipt of articles for washing and sanitizing, the method comprising:

performing a rinse cycle, the rinse cycle comprising:

filling the tub with a cold water rinse volume to a predetermined fill level, the cold water rinse volume having a temperature between 35 degrees Fahrenheit and 60 degrees Fahrenheit;

adding a volume of sanitizing additive to the tub;

performing an agitation cycle for a predetermined time period after filling the tub with the cold water rinse volume and adding the volume of sanitizing additive to the tub, wherein the cold water rinse volume and the sanitizing additive are mixed during the agitation cycle to form a sanitizing liquor;

draining the sanitizing liquor from the tub after performing the agitation cycle; and performing an extraction cycle after draining the sanitizing liquor from the tub;

whereby the washing machine appliance and articles therein are sanitized, wherein the cold water rinse volume is the only volume of water flowed into the tub during the entire rinse cycle.

12. The method of claim 11, further comprising activating a recirculation pump during at least a portion of the agitation cycle whereby the recirculation pump circulates the sanitizing liquor within a fluid distribution system of the washing machine appliance during at least a portion of the agitation cycle.

13. The method of claim 11, wherein the predetermined fill level is between about one gallon and two and a half gallons per pound of articles in the wash chamber.

14. The method of claim 11, wherein the volume of sanitizing additive is between about two milliliters and about four milliliters per liter of the cold water rinse volume.

15. The method of claim 11, wherein the predetermined time period for performing the agitation cycle is at least about fifteen minutes.

16. The method of claim 11, further comprising performing a wash cycle prior to the rinse cycle.

17. The method of claim 11, wherein the cold water rinse volume is at a temperature of between about 35 degrees Fahrenheit and about 60 degrees Fahrenheit.

18. The method of claim 11, wherein the cold water rinse volume is a first cold water rinse volume, further comprising filling the tub with a second cold water rinse volume to a second predetermined fill level and adding a volume of a second additive after performing the extraction cycle.

19. A method of operating a washing machine appliance, the washing machine appliance having a drum positioned within a tub, the drum defining a wash chamber for receipt of articles for washing and sanitizing, the method comprising:

performing a rinse cycle, the rinse cycle comprising:

filling the tub with a cold water rinse volume to a predetermined fill level, the cold water rinse volume having a temperature between 35 degrees Fahrenheit and 60 degrees Fahrenheit;

adding a volume of sanitizing additive to the tub;

performing an agitation cycle for a predetermined time period after filling the tub with the cold water rinse volume and adding the volume of sanitizing additive to the tub, wherein the cold water rinse volume and the sanitizing additive are mixed during the agitation cycle to form a sanitizing liquor consisting of the cold water rinse volume and the sanitizing additive;

draining the sanitizing liquor from the tub after performing the agitation cycle; and performing an extraction cycle after draining the sanitizing liquor from the tub;

whereby the washing machine appliance and articles therein are sanitized.

20. The method of claim 19, further comprising activating a recirculation pump during at least a portion of the agitation cycle whereby the recirculation pump circulates the sanitizing liquor within a fluid distribution system of the washing machine appliance during at least a portion of the agitation cycle.

* * * * *